US005971161A

United States Patent [19]

Branecky et al.

[11] Patent Number: 5,971,161

[45] Date of Patent: Oct. 26, 1999

[54] MAILPIECE SORTING DEVICE

[75] Inventors: George N. Branecky, Bethel; James F. Giordano, Danbury, both of Conn.

[73] Assignee: Pitney Bowes Inc., Stamford, Conn.

[21] Appl. No.: 08/880,549

[22] Filed: Jun. 23, 1997

[51] Int. Cl.[6] ..... B07C 9/00; B65H 29/40

[52] U.S. Cl. ..... 209/657; 209/540; 209/900; 271/178; 271/181

[58] Field of Search ..... 209/540, 541, 209/542, 545, 656, 657, 584, 900; 271/177, 178, 181, 184, 185

[56] References Cited

U.S. PATENT DOCUMENTS

| | | | |
|---|---|---|---|
| 4,718,660 | 1/1988 | Daboub | 209/657 X |
| 4,903,956 | 2/1990 | Stephens et al. | 271/178 |
| 5,064,185 | 11/1991 | Ricciardi | 271/181 |
| 5,226,547 | 7/1993 | Malatesta | 209/900 X |

FOREIGN PATENT DOCUMENTS

| | | | |
|---|---|---|---|
| 2555974 | 6/1985 | France | 271/178 |

*Primary Examiner*—Tuan N. Nguyen
*Attorney, Agent, or Firm*—Christopher J. Capelli; Melvin J. Scolnick

[57] ABSTRACT

The present invention provides a sorter preferably for an inserting system for sorting mailpieces into one of at least two sorting bins, the sorter having a transport device for conveying the mailpieces along a transport path. Each sorting bin includes a bending mechanism for bending the tail edge portion of a mailpiece and a final stacking roller for unbending the tail edge portion of the mailpiece such that the tail edge portion of the mailpiece is diverted into the sorting bin and away from the transport device without the occurrence of jamming of the mailpiece in the entry portion of the sorting bin.

15 Claims, 8 Drawing Sheets

MAILPIECE SORTING DEVICE

FIELD OF THE INVENTION

The present invention relates generally to sorting devices, and more particularly, to apparatus for sorting mailpieces at the output of inserting systems.

BACKGROUND OF THE INVENTION

Throughout the history of mail delivery, there has been a gradual evolution whereby the post office encourages mailers to prepare their mail in such a way as to reduce the effort required on the part of the post office for processing such mail. As an inducement to the mailer to prepare the mail in such a way so as to bring about faster mail delivery, the post office offers several levels of postage discount to mailers. The level of discount typically is based on the number of criteria met by the mailer. For example, in order to maximize such postage discounts, the post office requires that high volume mailers presort the mailpieces, apply a Zip+4 bar code to each mailpiece, and package their mail into trays with each tray tagged in accordance with the Domestic Mail Manual.

Previously, large volume mailers have performed the sorting process on conventional off-line sorting equipment, however the traying process is still performed manually. Smaller volume mailers may perform both the sorting and traying processes manually. Clearly such manual traying is not efficient for large volume mailers.

As described in commonly assigned U.S. Pat. No. 5,429,249 to Belec et al., this drawback was overcome by the direct interface of a multi-bin sorting device with an inserter system. This inserter system performs automated sorting of mailpieces in accordance with predetermined postal discount requirements. Essentially, the system consists of an inserter for assembling the mailpieces and a sorter coupled to the inserter for automatically sorting and traying the mailpieces. The sorter includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

In order to prevent the occasional jamming of envelopes as they are diverted into designated trays of the sorter device, the inserter system implemented an anti-jamming kicker gate. The kicker gate, when actuated, aligns with the actuated gate of a tray to allow smooth entry of a mailpiece from a transport of the inserter system into a tray of the sorting device. Upon deactuation, the kicker gate returns to its original position thereby "kicking" the tail of the mailpiece inwardly into the tray and away from the entry area of the tray. Such a kicker-gate mechanism is described in U.S. Pat. No. 4,718,660 to Daboub. But, even though this kicker gate proved to be reliable it suffered from occasional drawbacks in that the kicking gate occasional damaged a mailpiece through its "kicking" action against a mailpiece. Additional, this anti-jamming mechanism is complex and expensive to implement because it requires an exact timing scheme for actuation of the kicker gate.

Therefore, it is an object of the present invention to provide a sorting device that can be implemented at the output end on an inserting system having an improved mechanism for preventing jamming of mailpieces being conveyed into individual sorting bins of the sorting device.

SUMMARY OF THE INVENTION

The present invention provides a system and apparatus for assembling and sorting mailpieces according to requirements for receiving postal discounts. In a preferred embodiment, the system comprises a conventional inserter that outputs mailpieces to an on-edge, multi-bin sorter/stacker by way of a turn-up and alignment device and vertical transport. The turn-up and alignment device receives the mailpieces in a top edge, registered, horizontal orientation and deposits the mailpieces in a vertical orientation with its bottom edge registered against a fixed surface. The on-edge, multi-bin sorter/stacker, which sorts and stacks substantial quantities of mail in a vertical, on-edge orientation, includes a deck having a deck surface with a low coefficient of friction that is tilted at a specific angle to balance forces applied to the mailpieces being stacked regardless of the size and weight of the mailpieces.

In accordance with the present invention an inserter based system performs automated sorting of mailpieces in accordance with predetermined postal discount requirements. The system comprises an inserter for assembling the mailpieces and a sorter coupled to the inserter. The sorter includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

In order to prevent jamming of the mailpieces as they are conveyed into a sorting bin, each bin includes a gate movable between a first position and a second position. When the gate is in the first position, it permits the vertical transport device to continue to convey a mailpiece along the transport path of the transport device. And when the gate is in the second position, it diverts a mailpiece from the vertical transport device into an associated sorting bin. A stacking roller is mounted between the gate and an upstanding registration wall and is configured to convey a leading edge portion of a mailpiece against a registration wall when the gate is actuated to the second position. An elongate guide member is mounted in each bin that includes a bending end configured to bend a tail edge portion of the mailpiece having its leading edge portion in abutment with the registration wall. A final stacking roller is mounted in proximity to the bending end of the guide member wherein the distance between the final stacking roller and the registration wall is less than the length of a mailpiece. The final stacking roller is configured the rotate and unbend the bent tail edge portion of the mailpiece resting against the bending end of the guide member such that the tail edge portion of the mailpiece is diverted into the sorting bin and away from the transport device. Thus, the above mechanism prevents the jamming of the mailpiece in the entry portion of the sorting bin.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PREFERRED EMBODIMENT

Figure 1:
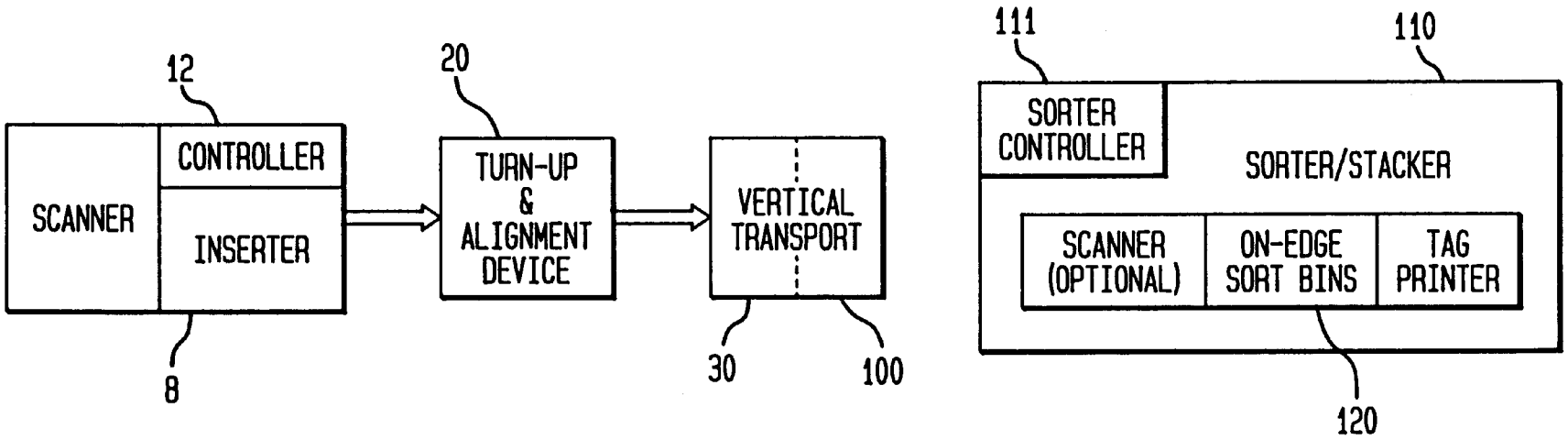
FIG. 1 is a block diagram of an inserter system including an on-line sorting module in accordance with the present invention.

In describing the present invention, reference is made to the drawings, wherein there is seen in FIG. 1 a block diagram of an inserter system, generally designated 10, which includes a sorting device, generally designated 110. It is to be appreciated that while the below described sorting device 110 is described in terms of a device which is "on-line" with inserter system 10, the sorting device 110 is not to be understood to be limited to such an "on-line" device, as it is to be understood to encompass a "stand-alone" sorting device. It is only for clarity of understanding of an inserting system 10 implementing sorting device 110 that the preferred embodiment of sorting device 110 is described in conjunction with inserter system 10.

Inserter system 10 comprises an inserter 8 that outputs mailpieces to a turn-up and alignment device 20 that turns the mailpieces on edge, bottom edge aligned. Vertical transports 30 and 100 transport the mailpieces to the on-edge sorter/stacker 110. A controller 12 of inserter 8 communicates to a controller 111 of sorter 110 whereby sorter 110 sorts the mailpieces according to requirements for postal discounts.

Figure 2:
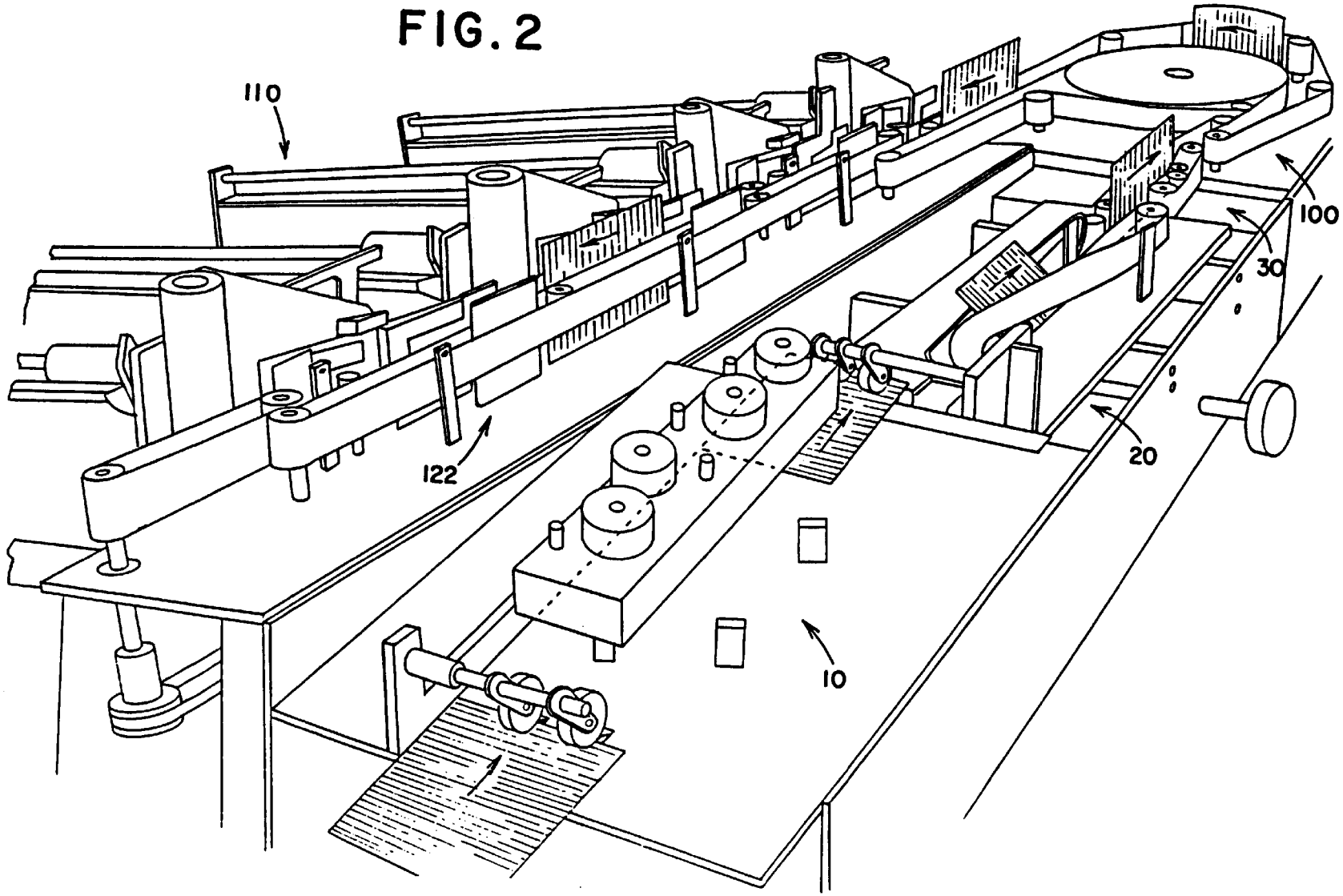
FIG. 2 is a perspective view of the on-line sorting module of FIG. 1 and transports leading thereto.

Referring now to FIG. 2, a series of modules are connected to perform on-line sorting of mailpieces output from an inserter or other mail finishing equipment. A top-edge alignment module 11 is connected to the output end of the inserter 8 (not shown). Module 11 receives mailpieces from the inserter 8 in a horizontal orientation, maintains top-edge registration of the mailpieces and delivers the mailpieces to a turn-up and alignment module 20 that is coupled to the output end of alignment module 11. Turn-up and alignment module 20 is adjustably positioned to obtain bottom-edge registration of the mailpieces while turning the mailpieces 90 degrees to a vertical orientation. Coupled to the exit of turn-up and alignment module 20 is a stationary vertical transport 30 that transports the mailpieces to a drum transport 100. Drum transport 100 is a vertical transport that moves the mailpieces along a U-shaped path to the sorter/stacker module 110.

Figure 3:
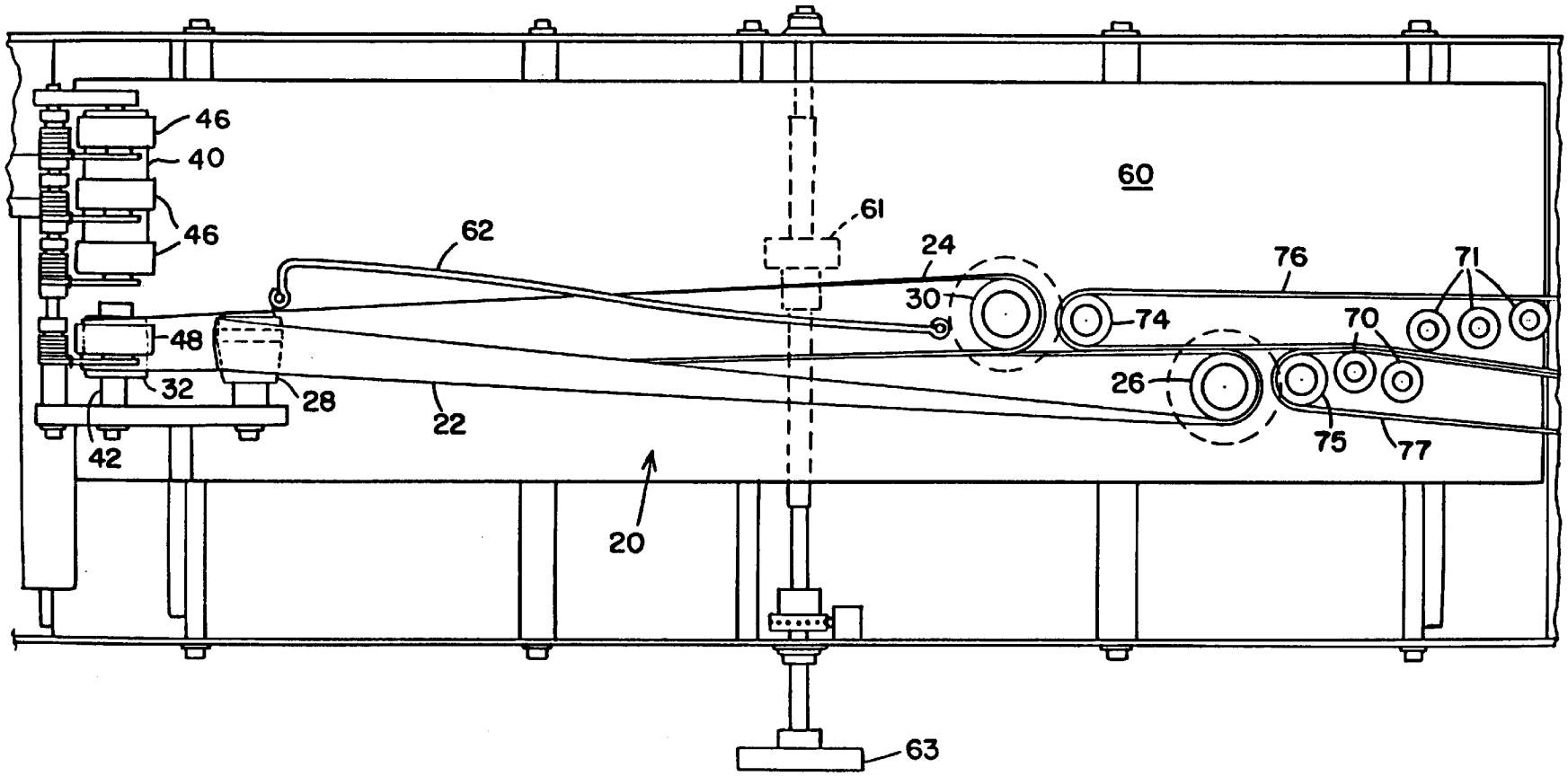
FIG. 3 is a top view of a turn-up and alignment transport of the transports in FIG. 2.

Referring now to FIG. 3, turn-up and alignment module 20 includes a pair of entrance pulleys 28 and 32, each of which has an offset crown and rotates on a stationary horizontal axis, and a pair of exit pulleys 26 and 30, each of which has a centerline crown. Entrance pulleys 28 and 32 are located longitudinally and vertically apart from one another such that one of the entrance pulleys 32 functions as lower entrance pulley and the other entrance pulley 28 functions as an upper entrance pulley, with upper entrance pulley 28 being located downstream from lower entrance pulley 32. Exit pulleys 26 and 30 rotate on a stationary vertical axis. Exit pulley 26 is located downstream from exit pulley 30. Turn-up and alignment module 20 further includes a pair of elastic, endless belts 22 and 24. Belt 24 is wrapped around lower entrance pulley 32 and upstream exit pulley 30. Belt 22 is wrapped around upper entrance pulley 28 and downstream exit pulley 26, whereby belts 22 and 24 complete a 90 degree twist from their respective entrance pulley to their respective exit pulley such that belts 22 and 24 each has a contiguous span for approximately the entire 90 degree twist against which a corresponding span of the other belt applies a normal force. Turn-up and alignment module 20 further preferably includes a contour wire guide 62 shaped to guide a portion of the flat article that is extending beyond the grip of the first and second belts through the ninety degree twist. A lower entrance roller 40 is adjacent lower entrance pulley 32 and rotates on the same horizontal axis as lower pulley 32. There are a plurality of idler rollers 46 and 48 biased against lower entrance roller 40 and lower idler pulley 32.

A more detailed description of turn-up and alignment module 20 and the transporting of the mailpieces from the inserter to sorter/stacker 110 is disclosed in commonly assigned U.S. Pat. Nos. 5,368,287 and 5,411,250, both of which are hereby incorporated by reference.

Figure 4:
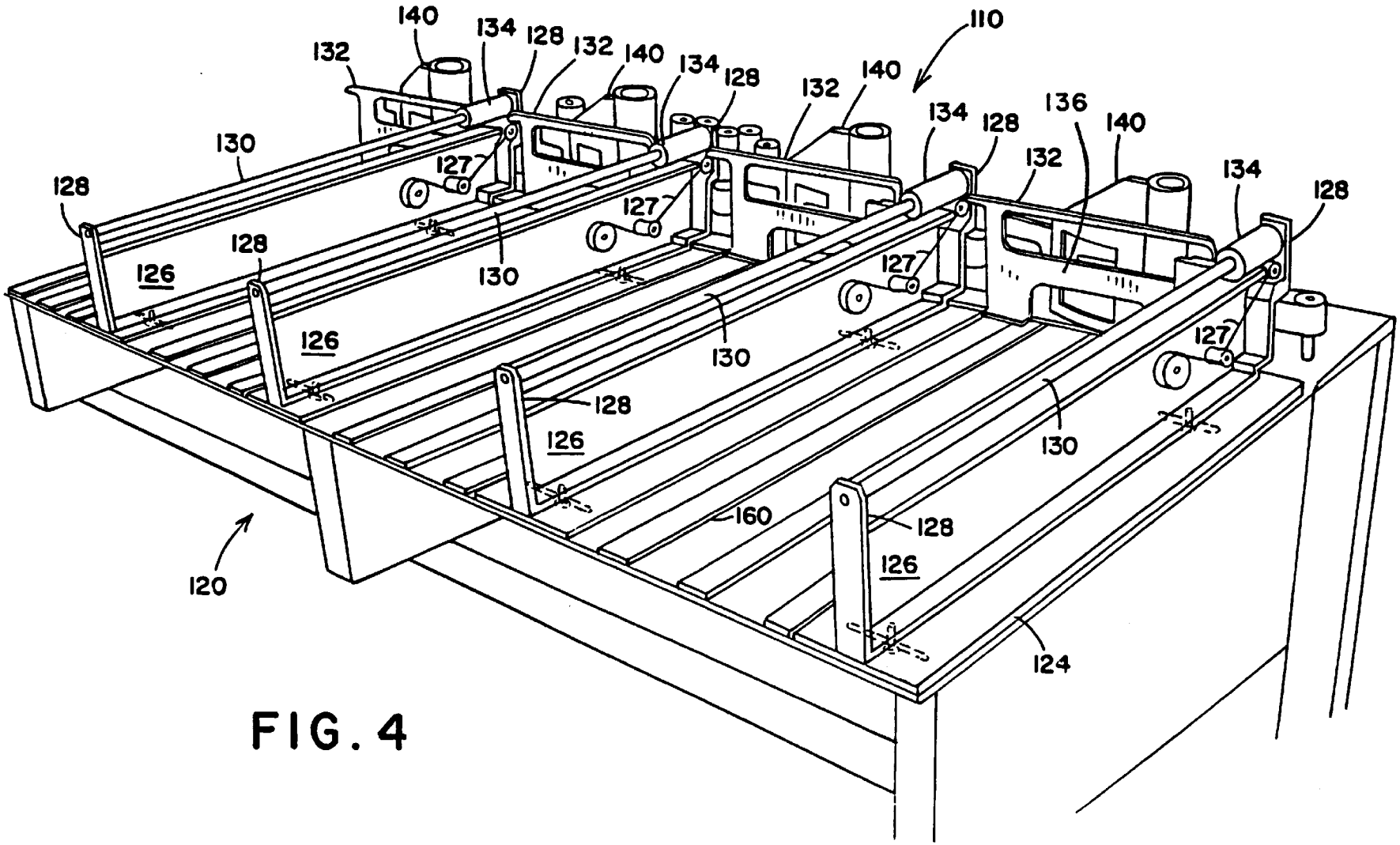
FIG. 4 is a perspective view of the sorting bins in the on-line sorting module of FIG. 1.
Figure 5:
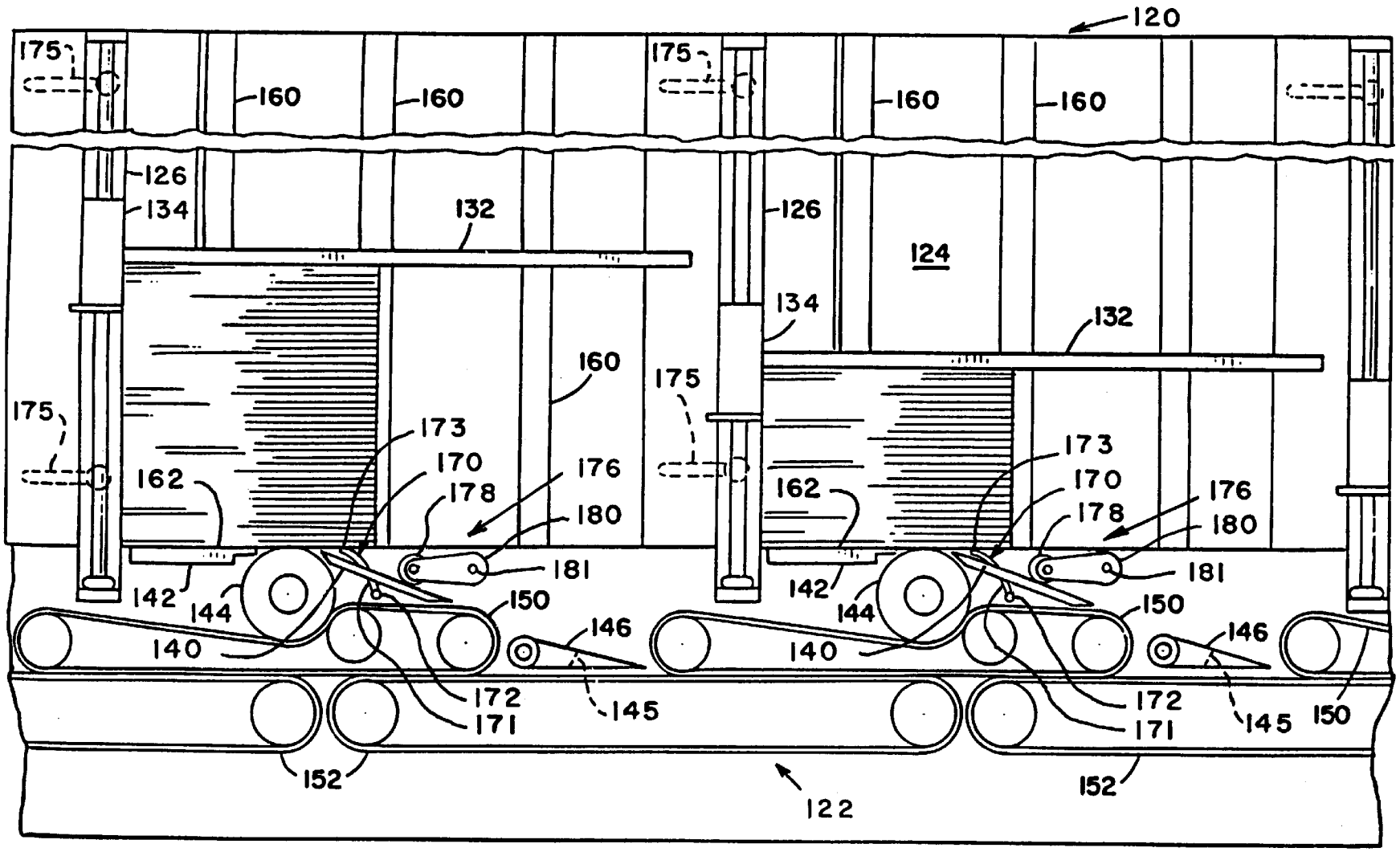
FIG. 5 is a top view of the on-line sorting module of FIG. 1.

Referring now to FIGS. 4 and 5, sorter/stacker 110 includes a plurality of bins, each generally designated 120, and a vertical transport, generally designated 122. Bins 120 include a base plate 124 and a plurality of registration walls 126 that are mounted to base plate 124. Registration walls 126 divide base plate 124 into separate bin sections. In the preferred embodiment of the present invention, four registration walls 126 are mounted at certain intervals along base plate 124 to make four separate bins. Each of registration walls 126 includes a pair of end members 128 having a section thereof extending above the top of registration wall 126. Each registration wall 126 has a bar 130 that longitudinally extends above the top of the wall and is mounted to the pair of end members 128. A paddle 132 is slidably mounted on each of the bars 130. Paddle 132 includes at one end a cylinder-shaped member 134 that is orthogonal to the flat section 136 of paddle 132. Cylinder member 134 includes an aperture through which paddle 132 is slidably mounted and is spring loaded on bar 130. In addition to moving up longitudinally along bar 130, paddle 132 can pivot about bar 130 allowing the removal of a stack from the corresponding bin 120.

Each bin 120 further includes a lead-in entry guide plate 140 and a pivoting guide surface 142. A fixed position urge stacking roller 144 is sandwiched between guide plate 140, guide surface 142 and transport belt 150. The stacking roller 144 is operational to urge an envelope between guide surface 142 and a previously stacked envelope until the lead edge portion of the envelope hits registration wall 126. An elongate adjustable guide member 170 extends through a cut-out portion defined in the lead-in entry guide plate 140. A mounting end 171 of the guide member 170 is adjustably mounted about a hinge member 172 upstanding from base plate 124. The opposing bending end 173 of the guide member 170 extends into the bin 120 adjacent the stacking roller 144 and is operational to force an envelope to bend and engage a final stacking roller assembly 176, as described further below.

The final stacking roller assembly 176 is provided in each bin 120 and is functional to urge the tail edge portion of an envelope into the bin 120, as will be discussed further below. The final stacking roller assembly 176 preferably consists of a driven stacking roller 178 rotatably mounted to a first end of a stacking arm 180. The opposing second end of the stacking arm 180 is pivotable mounted about a hinge member 181 upstanding from base plate 124. The stacking arm 180, and in turn, the driven stacking roller 178, is spring loaded towards the lead-in entry guide plate 140. The driven stacking roller 178 is caused to rotate in a clockwise direction by any suitable drive means (not shown) and is operative to drive an envelope against the registration wall 126 of a bin 120 and to cause the tail edge portion of an mailpiece to move away from the entry away of the bin 120, as will be discussed further below. The distance between the driven stacking roller 178 and the associated registration wall 126 is less than the lengthwise dimension of an envelope being processed in the sorter/stacker 110.

Each bin 120 also has a gate 146 that is actuated by a destination signal from the control system of sorter/stacker 110. Gate 146, when actuated, temporarily intersects the transport path of the transport system 122 to thereby divert an envelope from the transport path of the transport system 122 into the bin 120.

Vertical transport system 122 is a dual belt system comprising a plurality of inner belt sections 150 and outer belt sections 152. Inner and outer belt sections 150 and 152 include conventional drive and idler pulleys around which endless elastic belts are stretched. Gates 146 are located between inner belt sections 150, adjacent to the inner reach of outer belt sections 152 and extend parallel to the transport path of vertical transport system 122. Gates 146 pivot at one end about a vertical axis. Each gate 146 includes a rectangular open section 145 in the non pivoting end through outer belt 152 travels when gate 146 pivots thereto. Outer belt section 152 is shown with multiple belts.

Low abrasive strips 160 are preferably longitudinally fastened to the surface of base plate 124. As is described below, strips 160 must have a low coefficient of friction. In the preferred embodiment of the present invention, strips 160 are made of Delrin AF, manufactured by DuPont of Wilmington, Del. Strips 160 act as the deck of bins 120 as envelopes are stacked into bins 120. Strips 162 of Delrin are also fastened to guide surface 142 to facilitate the registration of an incoming envelope.

Figure 6:
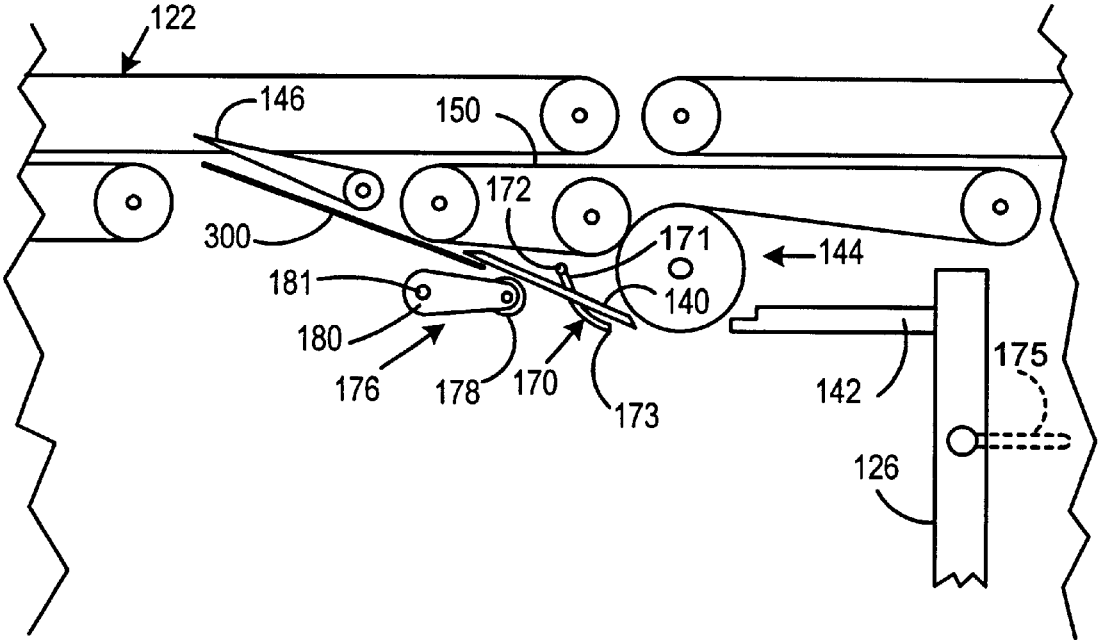
FIGS. 6–9 are top views illustrating various processing stages of a mailpiece in a sorting bin of the on-line sorting module of FIG. 1.
Figure 7:
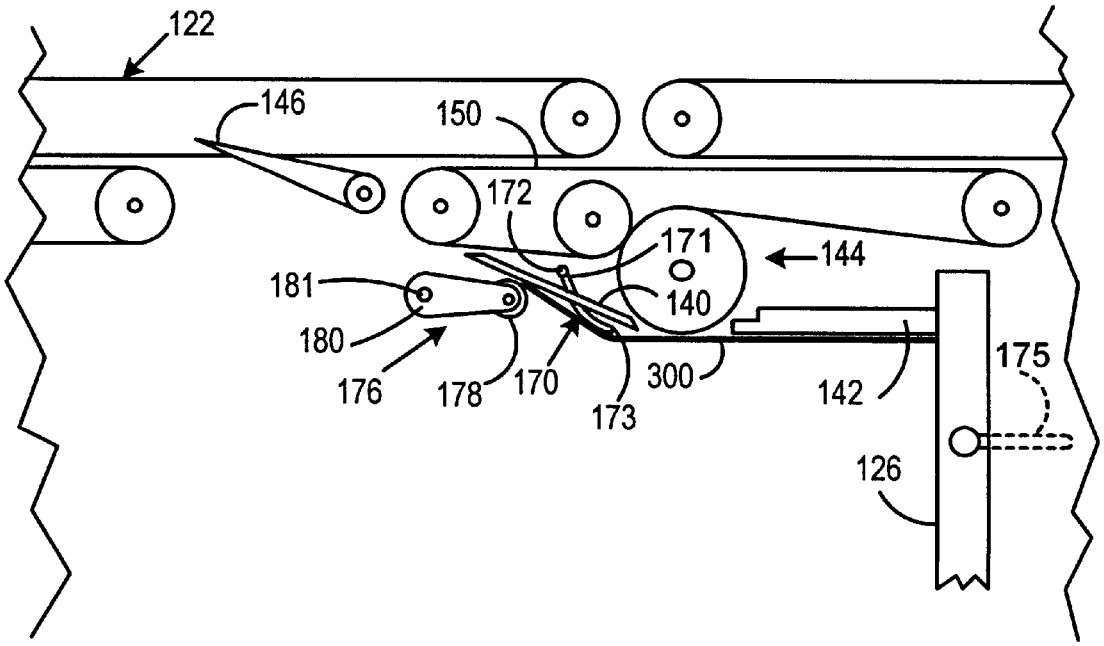
Figure 8:
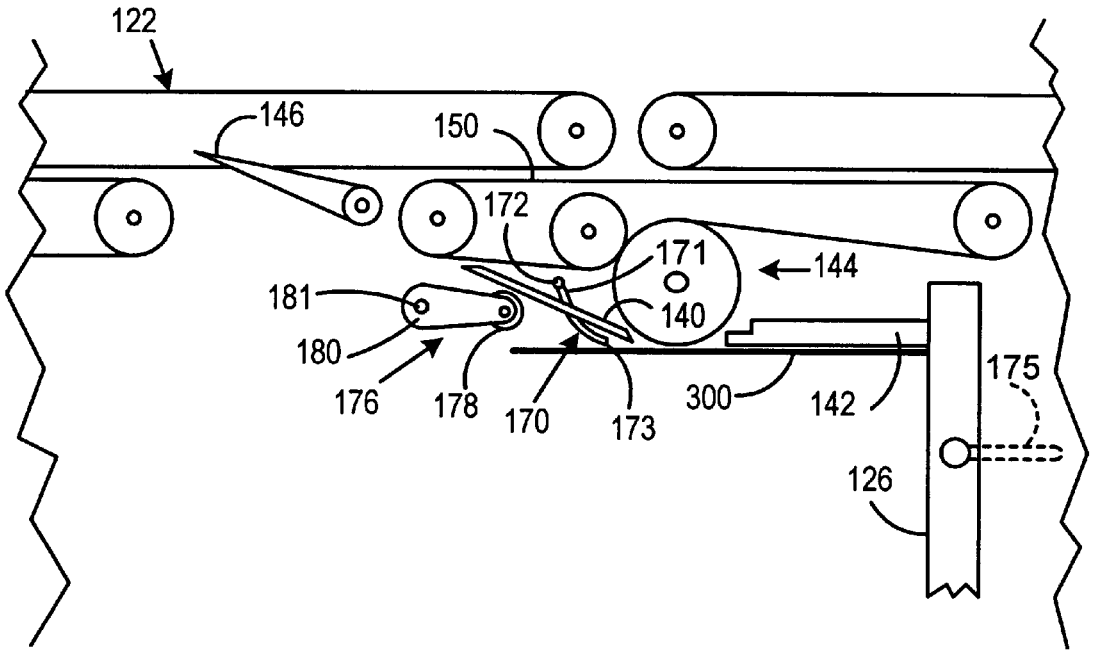
Figure 9:
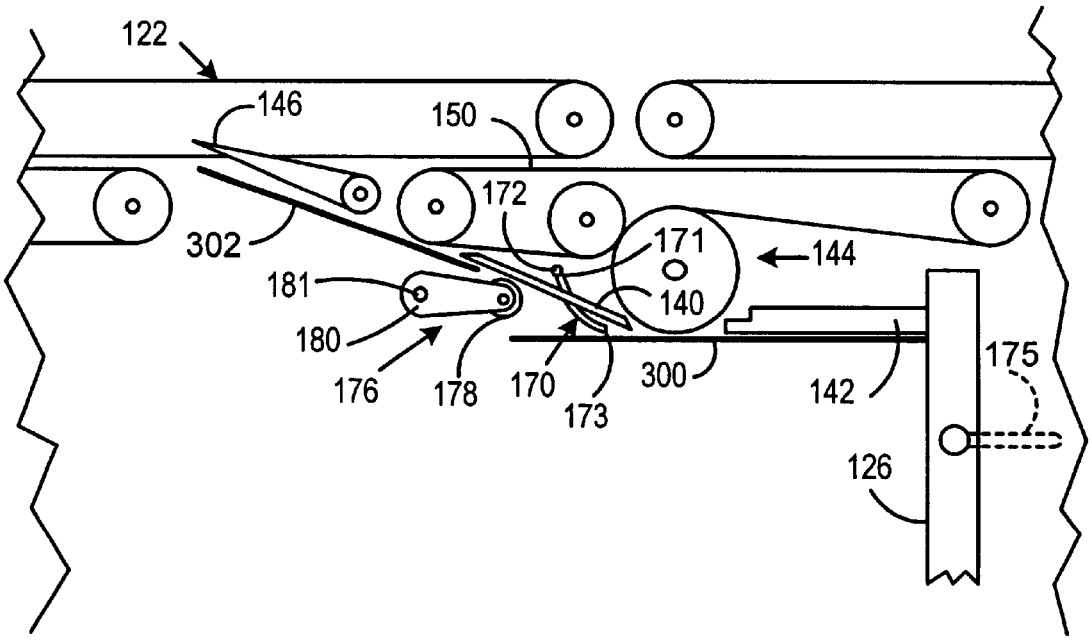

With the structure having been disclosed, and with reference to FIGS. 6–9, the operation of sorter/stacker 110 is set forth. Referring to FIG. 6, an envelope 300 is conveyed to sorter/stacker 110 from the upstream modules 10, 20, 30 and 100. As the envelope 300 is transported on edge by vertical transport system 122, the control system for the sorter/stacker causes a gate 146 of a bin 120 to deflect momentarily toward the adjacent outer belt. This causes the envelope 300 to deflect off gate 146 and follow guide plate 140 away from the transport path of transport system 122. Referring now to FIG. 7, the driven stacking roller 178 drives the envelope around the bending end 173 of the adjustable guide member 170, past the stacking roller 144, such that the leading edge portion of the envelope 300 abuts against the registration wall 126. Since the distance between the driven stacking roller 178 and the registration wall 126 is less than the length of the envelope 300, the tail edge portion of the envelope is caused to bend at the bending end 173 of the adjustable guide member 170. With reference to FIG. 8, the clockwise rotation of driven stacking roller 178 causes the bent portion of the tail edge of envelope 300 to flip about roller 178 whereafter the envelope 300 lays flatly against the previously stacked envelope (or paddle 132 if the bin is empty). As previously mentioned, the stacking roller 144 urges the envelope 300 between guide surface 142 and the previously stacked envelope until the lead edge of the envelope 300 abuts against registration wall 126. Next, and as shown in FIG. 9, a succeeding envelope 302 enters into bin 120, via transport system 122, whereafter the above described operation is once again repeated.

Sorter/stacker 110 does not need a mechanism to perform the traditional "stack advance" function. Instead, the entire stacker bin is angulated at a specific angle. This allows gravity to act on the stack of mailpieces being accumulated in the stacker bin and advance the stack as additional pieces enter. There are certain very specific conditions which allow such stacking device to be successful while stacking a great variety of different types of envelopes to stack lengths of 22 inches or greater.

Registration wall 126 is laterally adjustable to handle different size envelopes. The manner by which the vertical registration wall 126 is adjusted can be as simple or as complex as is desired. In the preferred embodiment of the present invention, a simple method to make the registration surface adjustable is to provide multiple sets of lateral slots 171 through which the registration surface can be laterally positioned and secured in a conventional manner. Slots 171 have a length sufficient for registration wall to be positioned over an entire range of desirable positions. An alternate embodiment provides multiple sets of discrete holes that facilitate an easy adjustment of registration wall 126 to several discrete positions for desired "trail edge lengths" of envelopes processed. An alternate and more elaborate means of adjusting the "trail edge lengths" of envelopes in their respective stacker bins is to provide, in addition to slots 171 of the preferred embodiment, a "lead-screw type" of mechanism to offer an easy operator adjustment and infinitely variable placement of the registration wall across all 126 envelope lengths.

Figure 10:
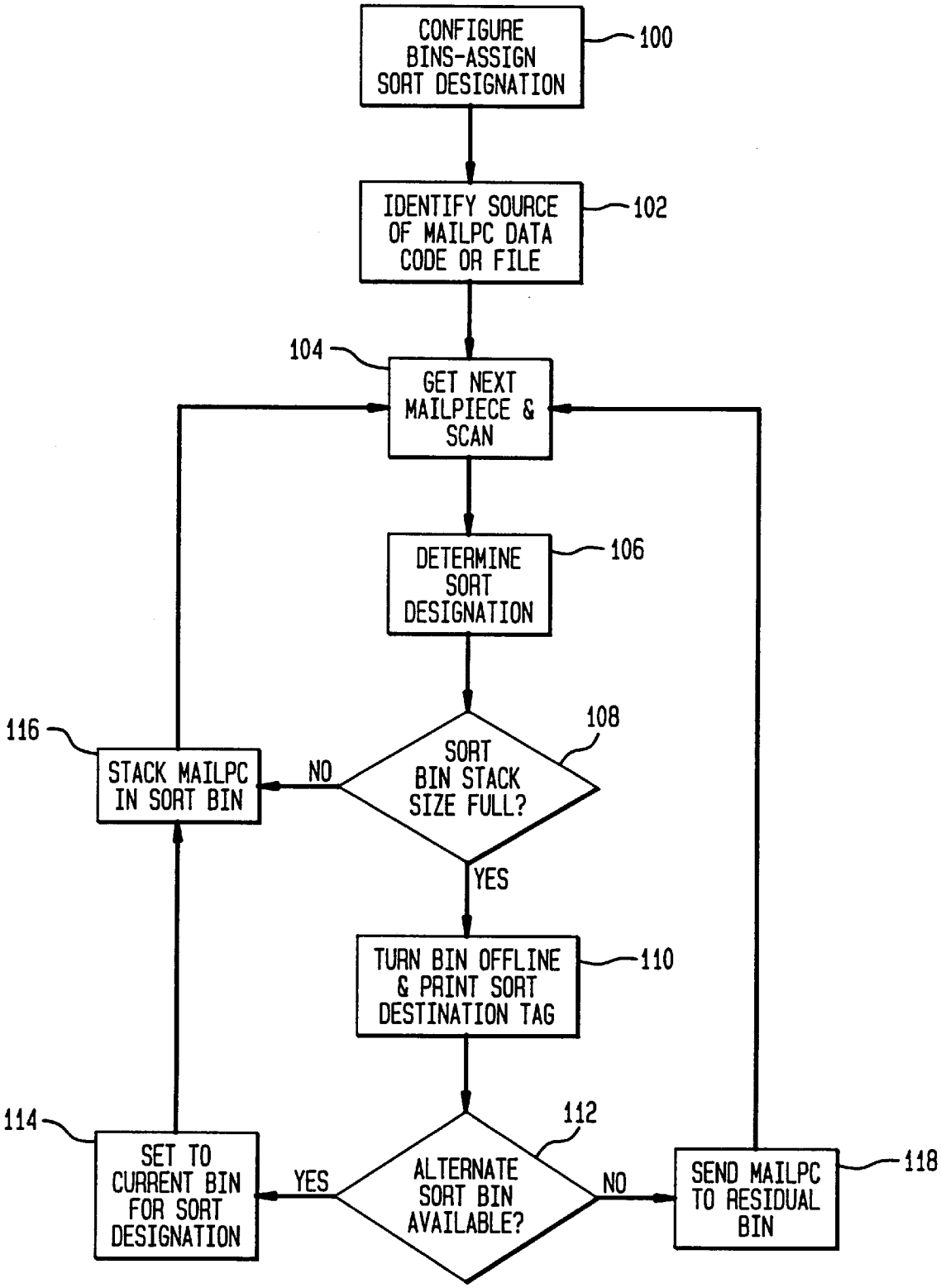
FIG. 10 is a flow chart of the sorting process.

Referring now to FIG. 10, a sorting algorithm performed by the sorter/stacker controller 111 is shown. On the basis of information received from inserter controller 12, sorting bins 120 are configured and assigned for sort designation at step 100. The source for mailpiece data code or file is identified at 102. The mailpiece processing begins at 104 when a mailpiece is scanned. In the preferred embodiment of the present invention, mailpiece information is generally tracked with each mailpiece as it is assembled and processed in the inserter, such that the mailpiece can be sorted with the need for further scanning at sorter/stacker 110. However, the scanning at sorter/stacker 110 serves to improve the integrity of the sorting process by verifying the mailpiece is indeed the mailpiece expected based on the information received from inserter controller 12.

At 106, the sort designation is determined. At 108, the stack size of the bin into which the mailpiece is to be sorted is checked. If the bin is full, then, at 110, the bin is turned off-line, i.e., unavailable for further sorting, and a sort destination tag is printed for the stack in the bin. At, 112, controller 111 determines if an alternate sort bin is available. If there is one, at 114 the alternate sort bin is designated as a current sort bin. At 116, the mailpiece is stacked in the sort bin. If the bin stack size was less than full at 108, then at 116 the mailpiece is stacked in the sort bin and the processing moves on to the next mailpiece at 104. If no alternate sort bin is available at 112, the mailpiece is sent to a residual bin at 118.

It has been found that the present invention is particularly advantageous in that the combination of the final stacking assembly 176 with the adjustable guide member 170 functions to prevent the jamming of a conveying envelope as it enters into a bin 120 of sorter/stacker 111. Specifically, it eliminates the jamming of the leading edge portion of a conveying envelope into the trailing edge of a preceding envelope positioned in the bin 120, as the conveying envelope enters into the bin.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. An inserter system having an inserter for assembling mailpieces and a transport device for conveying the mailpieces along a transport path from the inserter to a sorter, the sorter having at least one sorting bin, the at least one sorting bin comprising:

a gate movable between a first position and a second position, when in the first position the gate permits the transport device to continue to convey a mailpiece along the transport path and when in the second position the gate diverts a mailpiece from the transport path into the sorting bin;

a registration wall extending from an entry end of the sorting bin to a termination end of the sorting bin;

a stacking roller mounted between the gate and the registration wall and configured to convey a leading edge portion of a mailpiece against the registration wall after the gate is actuated to the second position;

a guide plate extending between the gate and the stacking roller;

an elongate guide member extending through a cutout portion defined in the guide plate such that a bending end of the guide member extends away from the guide plate at a predefined distance, the bending end of the guide member is configured to bend a tail edge portion of a mailpiece when the leading edge portion of the mailpiece abuts against the registration wall; and a final stacking roller mounted in proximity to the guide plate wherein the distance between the final stacking roller and the registration wall is less than the length of a mailpiece, the final stacking roller is configured the rotate and unbend the bent tail edge portion of the mailpiece resting against the bending end of the guide member such that the tail edge portion of the mailpiece is diverted into the sorting bin and away from the transport device.

2. An inserter system as recited in claim 1, wherein the registration wall is movable to accommodate different size mailpieces.

3. An inserter system as recited in claim 1, wherein the elongate guide member is movable such that the distance the bending end of elongate guide member and the guide plate is adjustable.

4. An inserter system as recited in claim 1, wherein the final stacking roller is driven by driving means.

5. An inserter system as recited in claim 4, wherein the final stacking roller is urged towards the guide plate.

6. An inserter system as recited in claim 5 further including:

a controller provided in the sorter; and means for communicating mailpiece data and configuration data to the sorter controller, wherein the sorter controller controls the sorting of mailpieces received from the inserter into sort groups according to postal discounts.

7. An inserter system as recited in claim 6, wherein the transport device includes a turn-up and alignment device located between the inserter and the sorter, the turn-up and alignment device turning the mailpieces from a horizontal alignment out of the inserter to a vertical alignment into the sorter.

8. A sorter for sorting mailpieces into one of at least two sorting bins, the sorter having a transport device for conveying the mailpieces along a transport path in the sorter, each sorting bin comprising:

a gate movable between a first position and a second position, when in the first position the gate permits the transport device to continue to convey a mailpiece along the transport path and when in the second position the gate diverts a mailpiece from the transport path into the sorting bin;

a registration wall extending from an entry end of the sorting bin to a termination end of the sorting bin;

a guide plate mounted in proximity to the movable gate and configured to guide a mailpiece into the entry end of the sorting bin when the movable gate is actuated to the second position;

an elongate guide member extending through a cutout portion defined in the guide plate such that a bending end of the guide member extends away from the guide plate at a predefined distance, the bending end of the guide member is configured to bend a tail edge portion of a mailpiece when the leading edge portion of the mailpiece abuts against the registration wall; and a final stacking roller mounted in proximity to the guide plate wherein the distance between the final stacking roller and the registration wall is less than the length of a mailpiece, the final stacking roller is configured to rotate and unbend the bent tail edge portion of the mailpiece resting against the bending end of the guide member such that the tail edge portion of the mailpiece is diverted into the sorting bin and away from the transport device.

9. A sorter as recited in claim 8 further including a stacking roller mounted between the movable gate and the registration wall and configured to convey a leading edge portion of a mailpiece against the registration wall when the gate is actuated to the second position.

10. A sorter as recited in claim 9, wherein the registration wall is movable to accommodate different size mailpieces.

11. A sorter as recited in claim 8, wherein the elongate guide member is movable such that the distance between the bending end of the elongate guide member and the guide plate is adjustable.

12. A sorter as recited in claim 8, wherein the final stacking roller is driven by driving means.

13. A sorter as recited in claim 12, wherein the final stacking roller is urged towards the guide plate.

14. A sorter as recited in claim 8 further including:

a controller provided in the sorter; and means for communicating mailpiece data and configuration data to the sorter controller, wherein the sorter controller controls the sorting of mailpieces into sort groups according to postal discounts.

15. A sorter as recited in claim 8, wherein the transport device includes a turn-up and alignment device located between the sorter and an inserter, the turn-up and alignment device turning the mailpieces from a horizontal alignment out of the inserter to a vertical alignment into the sorter.

* * * * *